US011034550B2

(12) United States Patent
Christen et al.

(10) Patent No.: US 11,034,550 B2
(45) Date of Patent: Jun. 15, 2021

(54) METHOD FOR CONSTRUCTING AN ELEVATOR SYSTEM HAVING AN ADAPTABLE USABLE LIFTING HEIGHT

(71) Applicant: Inventio AG, Hergiswil (CH)

(72) Inventors: Lukas Christen, Glattpark/Opfikon (CH); Pascal Bläsi, Dierikon (CH)

(73) Assignee: INVENTIO AG, Hergiswil (CH)

( * ) Notice: Subject to any disclaimer, the term of this patent is extended or adjusted under 35 U.S.C. 154(b) by 291 days.

(21) Appl. No.: 16/310,588

(22) PCT Filed: Jun. 29, 2017

(86) PCT No.: PCT/EP2017/066169

§ 371 (c)(1),
(2) Date: Dec. 17, 2018

(87) PCT Pub. No.: WO2018/002243

PCT Pub. Date: Jan. 4, 2018

(65) Prior Publication Data

US 2019/0322491 A1 Oct. 24, 2019

(30) Foreign Application Priority Data

Jun. 30, 2016 (EP) ..... 16177321

(51) Int. Cl.
*B66B 19/02* (2006.01)
*B66B 7/06* (2006.01)

(52) U.S. Cl.
CPC ..... *B66B 19/02* (2013.01); *B66B 7/068* (2013.01)

(58) Field of Classification Search
CPC ..... B66B 19/02; B66B 7/068
See application file for complete search history.

(56) References Cited

U.S. PATENT DOCUMENTS 1,132,769 A 3/1915 Gale, Sr.
5,033,586 A * 7/1991 Richards ..... B66B 9/187 187/259

(Continued)

FOREIGN PATENT DOCUMENTS

CN 2359259 Y 1/2000
CN 204675583 U 9/2015

(Continued)

*Primary Examiner* — Michael A Riegelman
(74) *Attorney, Agent, or Firm* — William J. Clemens; Shumaker, Loop & Kendrick, LLP

(57) ABSTRACT

A method for constructing an elevator system in a building includes performing at least one lifting operation to adapt a usable lifting height of the elevator system to an increasing height of the building. A drive platform supporting an elevator drive machine and, by a flexible support, an elevator car and a counterweight is raised during the lifting operation. A difference between an elevator-car-side support weight and a counterweight-side support weight is substantially compensated by a compensating tension device guided from a bottom side of the elevator car to a bottom side of the counterweight by a deflecting device including two roller assemblies having deflecting rollers forming a compensating tension loop. A distance between the roller assemblies is reduced before and/or during the lifting operation such that an amount of the compensating tension device required for the performance of the lifting operation is released from the compensating tension loop.

15 Claims, 4 Drawing Sheets

(56) References Cited

U.S. PATENT DOCUMENTS

| | | | | |
|---|---|---|---|---|
| 5,513,724 | A * | 5/1996 | De Jong | B66B 5/284 187/264 |
| 9,604,820 | B2 * | 3/2017 | De Jong | B66B 11/00 |
| 10,501,289 | B2 * | 12/2019 | Rasanen | B66B 19/005 |
| 2012/0291395 | A1 * | 11/2012 | Plathin | B66B 19/02 52/741.1 |
| 2013/0111723 | A1 * | 5/2013 | Forsstrom | B66B 19/02 29/401.1 |
| 2014/0000987 | A1 * | 1/2014 | Peacock | B66B 19/007 187/414 |
| 2014/0231179 | A1 * | 8/2014 | Alasentie | B66B 7/062 187/251 |
| 2015/0034425 | A1 * | 2/2015 | Ratia | B66B 11/008 187/249 |
| 2015/0362450 | A1 * | 12/2015 | Lehtinen | G01N 27/20 187/391 |
| 2019/0023536 | A1 * | 1/2019 | Christen | B66B 11/008 |
| 2019/0193995 | A1 * | 6/2019 | Christen | B66B 11/0005 |
| 2019/0276277 | A1 * | 9/2019 | Christen | B66B 11/0005 |
| 2019/0322491 | A1 * | 10/2019 | Christen | B66B 19/00 |
| 2019/0330022 | A1 * | 10/2019 | Christen | B66B 9/00 |
| 2020/0277158 | A1 * | 9/2020 | Christen | B66B 19/002 |

FOREIGN PATENT DOCUMENTS

| | | | |
|---|---|---|---|
| CN | 105668383 | A | 6/2016 |
| EP | 2711324 | A1 | 3/2014 |
| JP | H06263369 | A | 9/1994 |
| JP | 2760676 | B2 | 6/1998 |
| WO | 0050328 | A2 | 8/2000 |
| WO | 2010023350 | A1 | 3/2010 |
| WO | 2011080387 | A1 | 7/2011 |

* cited by examiner

4 DRIVE MACHINE
6 COUNTERWEIGHT
27 CLAMP
46 DISPLACEMENT DEVICE

CAR
5
6
F1
F2
(F2)
$F_A$
$F_G$
36,37,(38)
36; 39
41 (42)
57 (58)

4 DRIVE MACHINE
6 COUNTERWEIGHT
46 DISPLACEMENT DEVICE
58.1 FIXING DEVICE
59.1 FIXING DEVICE

METHOD FOR CONSTRUCTING AN ELEVATOR SYSTEM HAVING AN ADAPTABLE USABLE LIFTING HEIGHT

FIELD

The present invention relates to a method for constructing an elevator system, in which at least one lifting operation is performed in order to adapt a usable lifting height of the elevator system to an increasing height of the building, and to an elevator system which is created by a method of this kind.

BACKGROUND

Before an elevator system can be operated in its normal operating mode, it may be installed in a building during a construction phase. The elevator system can then be used during the construction phase for the vertical transport of people or material, wherein the usable lifting height of the elevator system can be adapted during construction of the building to the current height thereof and therefore grows together with the building. Separate external elevators, which for example are installed on the outside of the building, can thus be spared entirely or in part.

For example, it can be expedient to mount the elevator system with an elevator drive machine, an elevator car and a counterweight in the elevator shaft intended herefor if preferably a number of lower floors of the building have been constructed at least in the region of the elevator shaft. The elevator car and further components of the elevator system can be suspended here from a drive platform, which for example can be raised to the next-highest level using a crane or by other means, so as to increase the usable lifting height or the transport path of the elevator system.

For example, in the case of an elevator of this kind—usually referred to as a climbing lift—the guide rails of the elevator system can be installed in the elevator shaft successively during the construction phase, and the drive platform can be transported upwardly along these guide rails as necessary. The drive platform can then be fixed at the desired higher level, for example using braces which are pushed out from the drive platform into openings in the walls of the elevator shaft.

Document WO 00/50328 A2 discloses a system for constructing an elevator. This system comprises a drive platform with an elevator machine, wherein an elevator car and a counterweight are suspended from the drive platform via suspension ropes. For the purpose of adapting the transport height of the elevator to an increasing building height, the drive platform can be raised in steps. A compensating rope is also provided, which runs from the bottom side of the elevator car, around deflecting rollers arranged beneath the elevator car and around a deflecting roller arranged on the counterweight to a rope clamping apparatus. The compensating rope is fixed at the rope clamping apparatus, wherein—once the rope clamping apparatus has been opened—additional compensating rope can be fed through the open rope clamping apparatus from a rope reservoir when the drive platform is raised.

Document EP 2 711 324 A1 discloses an elevator system, the lifting height of which likewise can be adapted to an increasing height of a building by raising, in steps to a new level, a supporting structure with a drive machine from which two elevator units—an elevator car and a counterweight—are suspended via a tension means. The elevator system is characterized in that the same tension means is used both as supporting means and as compensating tension means, wherein the tension means is guided uninterrupted from the region disposed above one of the elevator units, along this elevator unit, to the region disposed below the same elevator unit and is fixed on the elevator unit. Tension means from a tension means store is additionally fed by the extension of the tension means necessary to raise the supporting structure, both in the supporting region and in the compensating tension means region of said tension means, wherein in each case at least two tension means clamping apparatuses fixing the tension means have to be released and clamped again once the tension means feed is complete.

Both elevator systems have the significant disadvantage that tension means clamping apparatuses act on tension means regions which are later required as supporting means or compensating tension means which are loaded and run via pulleys. As a result of the clamping, individual wires and the overall wire rope structure of the supporting means can be deformed and weakened.

SUMMARY

An object of the present invention lies in proposing a method for constructing an elevator system having an adaptable lifting height, and a corresponding elevator system which do not have the aforementioned disadvantage.

There may be a need to use the same tension means, which can serve as supporting means and/or as traction means or as compensating tension means, during the entire construction phase of the building, to use a tension means multiple times in various elevators, and/or to continue to use a tension means used during the construction phase also during the permanent operating phase after the construction phase.

The term "tension means" is to be understood here generally and for example includes round ropes and belts containing cords made of steel or plastics materials. Hereinafter, tension means used as supporting means and traction means will be referred to as supporting means for the sake of simplicity.

Possible features and advantages of embodiments of the invention can be considered, amongst other things and without limiting the invention, to be based on ideas and findings described hereinafter.

The invention relates to a method for constructing an elevator system in a building. The elevator system comprises an elevator drive machine, an elevator car, a counterweight, and at least one flexible supporting means. In the method at least one lifting operation is performed in order to adapt a usable lifting height of the elevator system to an increasing height of the building, in which lifting operation a drive platform, which supports the elevator drive machine and, by means of the supporting means, the elevator car and the counterweight, is raised. In the method a difference between an elevator-car-side supporting-means weight and a counterweight-side supporting-means weight is substantially compensated by means of at least one compensating tension means, which is guided from a bottom side of the elevator car to the bottom side of the counterweight by means of a deflecting device. The method is characterized in that the deflecting device comprises two roller assemblies each having at least one deflecting roller, and the at least one compensating tension means is guided by means of at least one deflecting roller of each of the two roller assemblies in such a way that the compensating tension means forms a compensating tension means loop, wherein a distance between the first roller assembly and the second roller assembly is reduced before and/or during the lifting operation such that an amount of the compensating tension means sufficient for the performance of the lifting operation is released from the at least one compensating tension means loop.

The invention also relates to an elevator system which is designed to carry out the method according to the above description.

The compensating tension means can be an elongate, flexible body—for example a wire rope or a flat belt—which has a suitable weight per meter and is suitable for transmitting a tensile force along its longitudinal direction. Furthermore, the compensating tension means must be suitable for being directed via deflecting rollers. A deflecting roller is preferably a disc-shaped deflecting body which is rotatable about an axis of rotation and which at its periphery comprises a support zone for the compensating tension means, against which the compensating tension means bears and is deflected. For compensating tension means with a round cross-section, the contact zone usually has grooves arranged in the peripheral direction, and for flat compensating tension means the resting zone is at least approximately cylindrical.

The at least one compensating tension means arranged between the elevator car and the counterweight is guided via a deflecting device arranged primarily in the lower region of the elevator system, which deflecting device comprises either two roller assemblies displaceable relative to one another and each comprising at least one deflecting roller, or one stationary roller assembly comprising at least one stationary deflecting roller and one displaceable roller assembly comprising at least one displaceable deflecting roller. In so doing, the compensating tension means is guided via at least one deflecting roller of both roller assemblies in such a way that the at least one compensating tension means forms at least one compensating tension means loop. A compensating tension means loop contains a portion of the compensating tension means that runs around one or more deflecting rollers of both roller assemblies with one turn or with a number of turns and in so doing forms a compensating tension means store, from which an amount or length of the compensating tension means sufficient for a number of lifting operations is removed for the extension of the portions of the compensating tension means effective for the weight compensation.

An adaptation of the compensating device to the lifting height of the elevator system increased by the lifting operation is performed before and/or during the lifting operation in that the distance between the two roller assemblies each having at least one deflecting roller is reduced such that an amount of the compensating tension means sufficient to carry out the lifting operation is released from the at least one compensating tension means loop. Here, the aforesaid distance can be reduced in that either the distance between a stationary roller assembly and a displaceable roller assembly is reduced, or in that both roller assemblies are displaceable and are displaced in directions opposite one another.

In principle, there are a number of possibilities for carrying out a lifting operation in which the drive platform is raised. In a preferred possibility the elevator car is moved into the vicinity of the drive platform prior to the lifting operation and is coupled to the drive platform, this being implemented for example via a chain. During this operation, the counterweight is lowered into its lowermost operating position, is supported, and secured as appropriate. As the drive platform and the elevator car are raised, it is generally necessary for supporting means and compensating tension means to be fed as synchronously as possible. The compensating tension means can be connected at one of its fastening points to the bottom side of the elevator car, or it can run around a deflecting roller fastened to the elevator car. At its other fastening point, the compensating tension means can be connected to the bottom side of the counterweight, or it can run around a deflecting roller mounted on the counterweight. As the drive platform and the elevator car are raised, the compensating device, synchronously with the raising of the drive platform, can now be adapted by shortening the length of the compensating tension means guided and stored on the compensating tension means loop by reducing the distance between the two roller assemblies, whereby an appropriate length of the compensating tension means is available for the extension of the effective part of the compensating tension means necessary in the lifting operation of the drive platform and/or of the elevator car. It can be expedient to carry out at least some of these adaptation operations already before the lifting operation. An adaptation can also be performed after the lifting operation, in combination with additional measures. An adaptation of this kind after the lifting operation can be carried out for example once the counterweight has been raised as a result of the lifting operation.

In a preferred embodiment of the method the deflecting device is provided with a stationary roller assembly which comprises at least one stationary deflecting roller, and with a displaceable roller assembly which comprises at least one displaceable deflecting roller.

A method which is as simple as possible and which can be realized with minimal costs is thus achieved.

In a further possible embodiment of the method the amount of compensating tension means stored in the at least one compensating tension means loop is formed by a portion of the at least one compensating tension means guided from the bottom side of the elevator car, via the deflecting device, to the bottom side of the counterweight. As a result of this embodiment of the method, as the drive platform is raised—i.e. at the time of each lifting operation—the necessary amount of compensating tension means can be fed to the portions of the compensating tension means effective for the weight compensation, without a fixing device which clamps the compensating tension means having to be released and clamped again at another point of the compensating tension means.

In a further possible embodiment of the method a first fastening point of the compensating tension means is at least indirectly fixed to the elevator car and a second fastening point of the compensating tension means is at least indirectly fixed to the counterweight, or the compensating tension means is guided around a deflecting roller connected to the elevator car and around a deflecting roller connected to the counterweight. Of course, the compensating tension means is additionally guided here around the rollers of the deflecting device arranged at least in part in the lower region of the elevator system.

With the possibility of choosing between the two embodiments, either a single weight compensation effect or a twofold weight compensation effect can be attained with the same compensating tension means.

In a further possible embodiment of the method the at least one compensating tension means is fixed by means of fixing devices to the elevator car and to the counterweight or by means of stationary fixing devices to the elevator system, wherein the fixing devices are not dismantled prior to, during, or after a lifting operation—i.e. not until after completion of the last lifting operation.

As a result, the compensating tension means is not subjected to any deformation or any damage to the wire rope structure once the elevator system as a whole is complete, i.e. after multiple lifting operations, and therefore can continue to be used without reduction of the admissible tensile load.

In a further possible embodiment of the method the compensating tension means is guided with a single turn along the compensating tension means loop.

As a result, the roller assemblies of the deflecting device can be provided in a space-saving manner and economically, wherein however a greater path of displacement of at least one of the roller assemblies must be accepted.

In a further possible embodiment of the method, the compensating tension means is guided with more than one turn along the compensating tension means loop, or rather the compensating tension means is guided with multiple reeving along the compensating tension means loop.

As a result, the necessary path of displacement of at least one of the roller assemblies can be reduced accordingly, wherein however the roller assemblies of the deflecting device take up a greater installation space and can only be provided less economically. Here, additional compensating tension means can be guided or stored by the compensating tension means loop, the dimension of which in the direction of its displacement is generally limited by the available space, and can be released in the event of lifting operations of the drive platform. In the case of a compensating tension means loop with multiple reeving and vertically oriented displacement direction, there is thus the advantage that the ratio between the height of the elevator system in the end state to the height of the elevator system at the time of installation of the compensating tension means loop can be multiplied compared to a compensating tension means loop having just one turn (single reeving). Corresponding advantages can also be attained if the compensating tension means is guided along a compensating tension means loop having at least one roller assembly displaceable in the horizontal direction, or having horizontally displaceable deflecting rollers.

In a further possible embodiment of the method at least one of the roller assemblies used to form the compensating tension means loop is displaced with the aid of an electrically driven displacement device in order to reduce or increase the distance between the two roller assemblies guiding the compensating tension means loop.

With a displacement device of this kind, which for example can comprise an electrically driven supporting means drum or an electrically operated wire rope hoist, effortless displacement of the roller assemblies and therefore comfortable feeding of the at least one compensating tension means can be achieved.

In a further possible embodiment of the method, both of the roller assemblies used to form the compensating tension means loop are displaced in opposite directions by means of at least one displacement device.

By means of the displacement of both roller assemblies in opposite directions, either the necessary number of turns of the compensating tension means along the compensating tension means loop or the displacement path of the individual roller assembly can be reduced.

In a further possible embodiment of the method, at least one of the roller assemblies used to form the compensating tension means loop is displaced approximately synchronously with the raising of the drive platform occurring during the lifting operation.

As a result, during the raising of the drive platform, compensating tension means can be released in such a way that the compensating tension means remains substantially stretched and therefore continues to be guided by the deflecting rollers. Depending on the application, however, alternatives to the displacement of the displaceable roller assembly of the compensating tension means loop synchronously with the lifting operation are also conceivable. For example, part of the displacement of the compensating tension means loop can be performed already prior to the lifting operation. Here, it is also conceivable that the lifting operation is divided into sub-steps. It is then possible to alternate between a partial feed of the compensating tension means from the compensating tension means loop and a partial raising of the drive platform. It is hereby possible to prevent, for example, that a lifting device used to raise the drive platform and a lifting gear used to displace the compensating tension means loop operate against one another. Additional tensile forces in the supporting means of the lifting device, in the lifting gear and in the compensating tension means, and corresponding forces in the components concerned are thus avoided.

In a further possible embodiment of the method, the compensating tension means loop is arranged at least largely in the elevator shaft of the building associated with the elevator system, wherein at least one of the roller assemblies of the deflecting device is displaced substantially in a vertical displacement direction.

All essential components can hereby be arranged in the elevator shaft in which the elevator car is disposed. This facilitates in particular a monitoring of the operations during raising of the drive platform.

In a further possible embodiment of the method the compensating tension means loop is arranged at least in part in a further elevator shaft of the building not associated with the elevator system.

As a result, the elevator system can be equipped with an elevator car of maximum size, since no space has to be kept free in the associated elevator shaft for the compensating tension means loop to be disassembled following completion of the construction phase.

In a further possible embodiment of the method the compensating tension means loop is arranged at least in part in a space of the building not associated with an elevator shaft, and/or at least one of the roller assemblies of the deflecting device is displaced substantially in a horizontal displacement direction. An arrangement of this kind of the compensating tension means loop—for example in a hall of the building, in particular an underground car park hall—has the advantage that a plurality of adjacently arranged elevator shafts of a building can be equipped with elevator cars of maximum size, wherein, in the case of a compensating tension means loop with horizontal displacement direction, assembly and adjustment are much more easily implemented. In addition, a lifting gear or a wire rope hoist, which are used to displace the compensating tension means loop, can thus be arranged outside the elevator shaft in which the elevator car is disposed.

In a further possible embodiment of the method, elements used to form the compensating tension means loop are removed after the last lifting operation, and after the last lifting operation the deflecting device of the elevator system is converted into a deflecting device without compensating tension means loop.

Amongst other things, it is thus achieved that the compensating tension means does not have to run around the deflecting rollers of the compensating tension means loop in continuous operation, that the installation space of the compensating tension means loop is available for another use, that parts of the compensating tension means loop can be reused in order to construct a further elevator system, and that the removed components no longer have to be monitored and serviced.

Some of the possible features and advantages will be described with reference to various embodiments. The features can be suitably combined, adapted or exchanged in order to arrive at further embodiments.

Embodiments will be described hereinafter with reference to the accompanying drawings, wherein neither the drawings nor the description are to be interpreted as limiting the invention. Here, the drawings are merely schematic and are not to scale. Like reference signs in the various drawings denote like feature or features having the same effect.

DETAILED DESCRIPTION

Figures 1A, 1B:
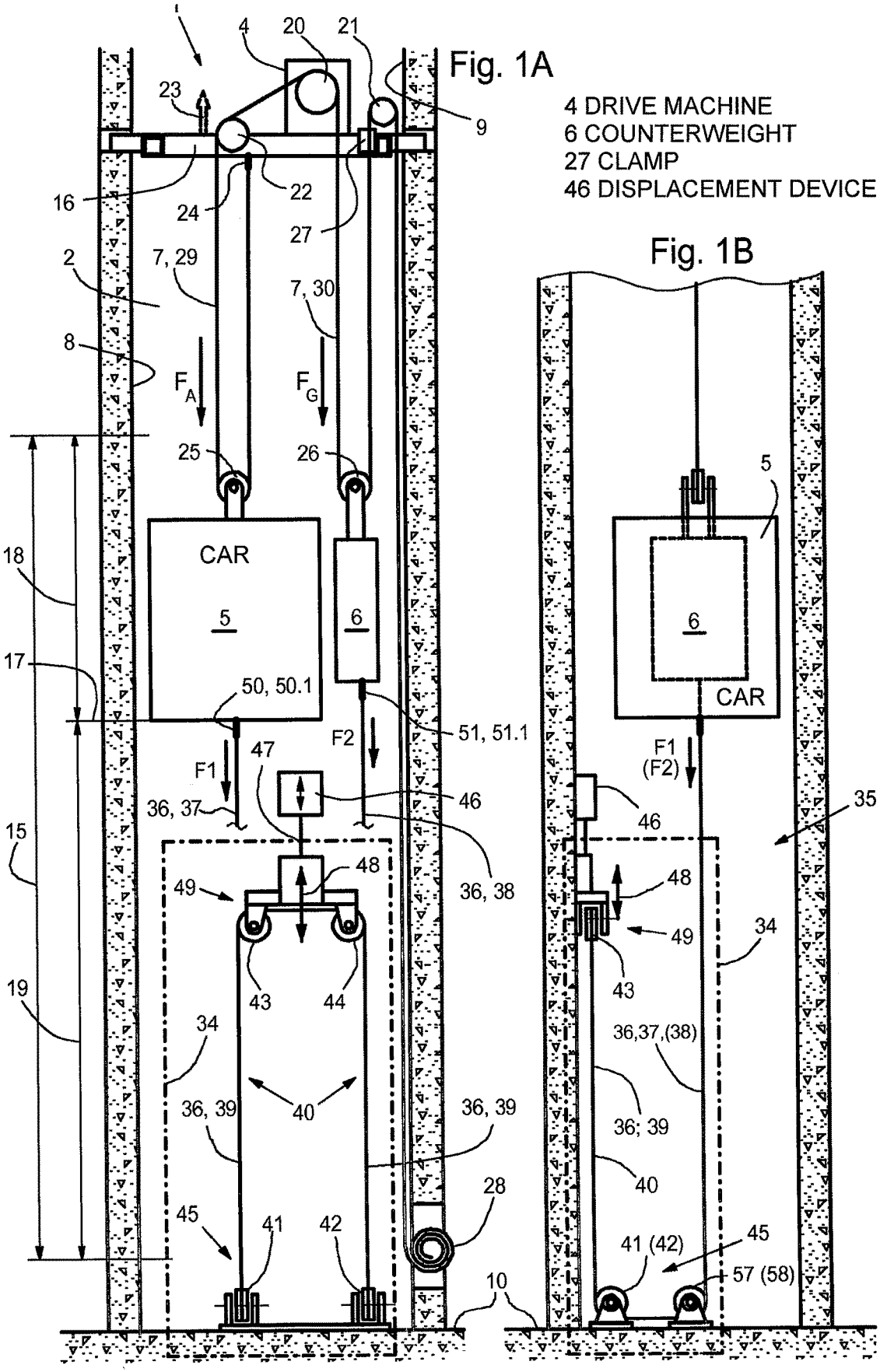
FIGS. 1A and 1B schematically show a front and side view of an elevator system according to one embodiment of the invention.

FIG. 1A schematically shows, in a front view, an elevator system 1 which is constructed in an elevator shaft 2 of a building. FIG. 1B, for improved comprehension of the depicted rope arrangement, shows the same elevator system 1 in a side view.

A method for constructing the elevator system 1 will also be described on the basis of the elevator system 1.

The elevator system 1 comprises an elevator drive machine 4, an elevator car 5, a counterweight 6, and at least one flexible supporting means 7. The elevator car 5 and the counterweight 6 are guided here along guide rails (not shown). In the described embodiment the elevator system 1 is arranged at least substantially within the elevator shaft 2. The elevator shaft 2 is delimited here laterally by shaft walls 8, 9. The elevator shaft 2 is delimited downwardly by a floor 10. Upwardly, the elevator shaft 2 is primarily open during the construction of the elevator system 1, wherein suitable coverings can be provided. If construction of the building is complete, the elevator shaft 2 is then closed at the top.

In the shown arrangement, a schematically depicted lifting height 15 is provided for the elevator car 5, since the elevator car 5 can travel at least approximately as far as the ground 10 and at least approximately as far as a drive platform 16. Proceeding from the shown position 17 of the elevator car 5, the elevator car 5 can thus be moved still upwardly over a path of travel 18 or downwardly over a path of travel 19. This is achieved by driving of the supporting means 7 by means of the elevator drive machine 4.

The drive platform 16 is used to support the elevator drive machine 4, which supports and drives the supporting means 7 and thus the elevator car 5 and the counterweight 6 by means of a friction hoist or sheave 20. In this exemplary embodiment, deflecting rollers 21, 22 are also mounted on the drive platform 16. In the event that the drive platform 16 is raised, as illustrated by the arrow 23, —i.e. in the event of a lifting operation for the purpose of adapting the usable lifting height of the elevator system to a current building height—the elevator drive machine 4 with the friction hoist 20 and the deflecting rollers 21, 22 are thus displaced jointly upwardly.

The arrangement of the supporting means 7 can be adapted to the particular application. In this exemplary embodiment an end 24 of the supporting means 7 is fastened to the drive platform 16. From there, the supporting means 7 runs to the elevator car 5 and around a deflecting roller 25 connected to the elevator car 5. From the deflecting roller 25, the supporting means 7 runs firstly around the deflecting roller 22 and then around the friction hoist 20, which are both arranged on the drive platform 16. From the friction hoist 20, the supporting means 7 runs to a deflecting roller 26 connected to the counterweight 6, runs around this deflecting roller, and then runs upwards to a supporting means clamp 27 mounted on the drive platform 16. During operation of the elevator, the supporting means 7 is fixed in the region of the supporting means clamp 27. Generally, the supporting means clamp 27 is opened only during a lifting operation, in which the drive platform 16 is raised in accordance with the arrow 23.

In this exemplary embodiment the supporting means 7, after the supporting means clamp 27, runs around the deflecting roller 21 and then downwards to a supporting means reservoir 28, which is disposed in the region of the ground 10. Supporting means can be released from the supporting means reservoir 28 when the lifting operation is performed, in which operation the drive platform 16 is raised in accordance with the arrow 23.

In accordance with the arrangement of the supporting means 7, an elevator-car-side supporting-means portion 29 and a counterweight-side supporting-means portion 30 are provided. The elevator-car-side supporting-means portion 29 generates an elevator-car-side supporting-means weight $F_A$. The counterweight-side supporting-means portion 30 generates a counterweight-side supporting-means weight $F_G$. The elevator-car-side supporting-means weight $F_A$ can be described as the force acting on the friction hoist 20 in the direction of the elevator car 5 in addition to the elevator car on account of the mass of the elevator-car-side supporting-means portion 29. Accordingly, the counterweight-side supporting-means weight $F_G$ can be described as the force acting on the friction hoist 20 in the direction of the counterweight 6 in addition to the counterweight by the mass of the counterweight-side supporting-means portion 30.

Since in the arrangement shown in FIGS. 1A and 1B the elevator car 5 and the counterweight 6 are at least approximately at the same height, the elevator-car-side supporting-means weight $F_A$ and the counterweight-side supporting-means weight $F_G$ are also at least approximately of the same magnitude, which is shown by force arrows of equal length in FIG. 1.

Figure 2:
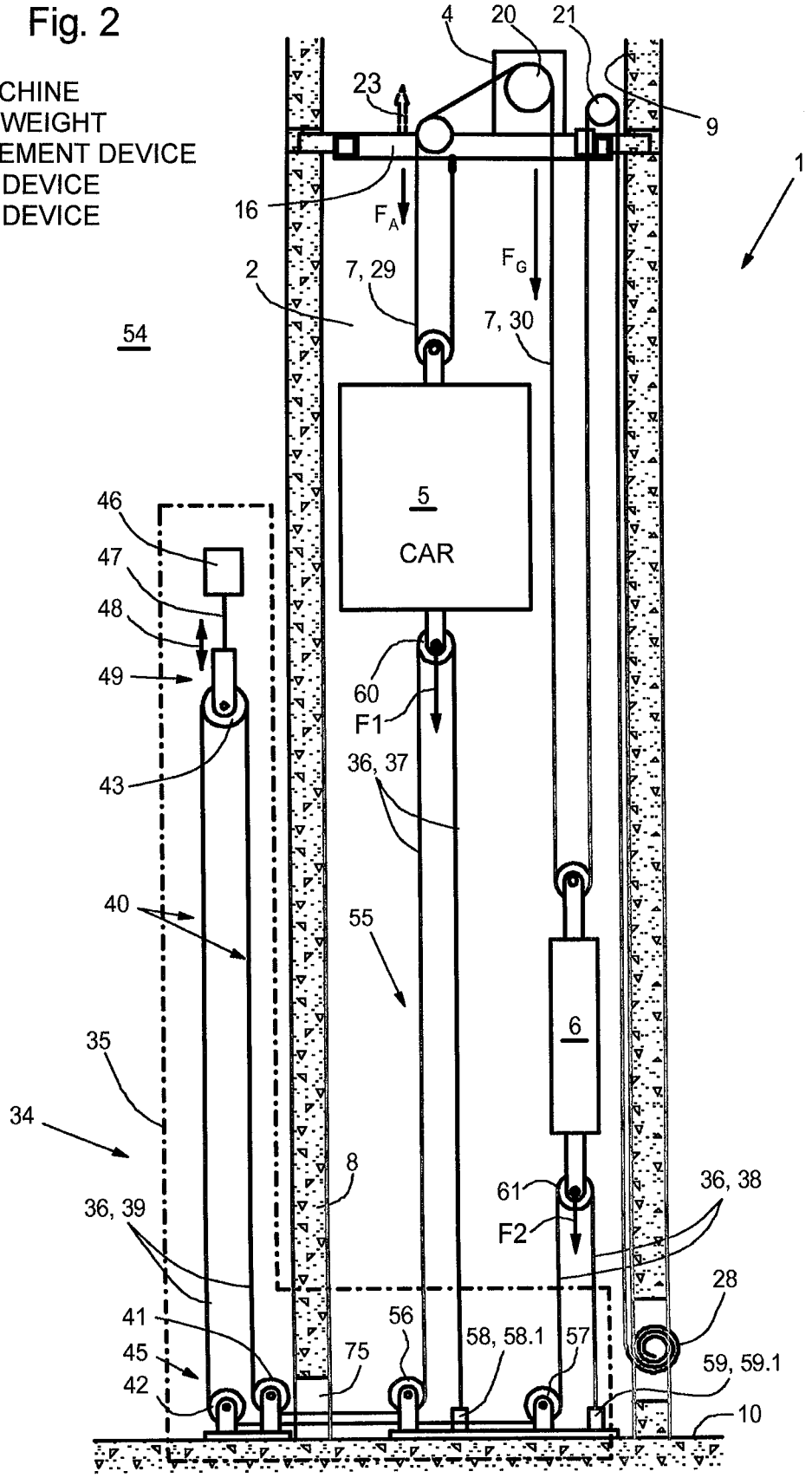
FIG. 2 schematically shows an elevator system in accordance with a further embodiment of the invention.

For comparison, the situation shown in FIG. 2 can be used, in which the elevator car 5 is closer to the drive platform 16 than the counterweight 6. Since the elevator-car-side supporting-means portion 29 is then considerably shorter than the counterweight-side supporting-means portion 30, the elevator-car-side supporting means weight $F_A$ is also smaller than the counterweight-side supporting-means weight $F_G$. This is illustrated in FIG. 2 in that the force arrow $F_A$ is shorter than the force arrow $F_G$.

Differences between the elevator-car-side supporting means weight $F_A$ and the counterweight-side supporting-means weight $F_G$ with otherwise unchanged design are all the greater, the greater is the usable lifting height 15. This means that a compensation between the elevator-car-side supporting-means weight $F_A$ and the counterweight-side supporting-means weight $F_G$ is of particular importance if large usable lifting heights 15 are provided when constructing the building and thus when constructing the elevator system. This is because, besides a load-dependent force, which generally can be compensated only partially by means of the counterweight 6, the difference between the elevator-car-side supporting-means weight $F_A$ and the counterweight-side supporting-means weight $F_G$ acts on the friction hoist 20 or on the elevator drive machine 4. This difference is compensated at least substantially by a compensating device 34. Substantially only a force not compensated by the counterweight 6 and dependent on the load of the elevator car 5, which force loads the friction hoist 20 with a torque, then still remains. Differences between the elevator-car-side supporting-means weight $F_A$ and the counterweight-side supporting-means weight $F_G$ are compensated at least substantially by the compensating device 34, such that in this respect no additional torque acts on the friction hoist 20.

The compensating device 34 comprises a flexible compensating tension means 36, which is guided from a bottom side of the elevator car 5, via a deflecting device 35 arranged in the lower region of the elevator car, to a bottom side of the counterweight 6. The compensating tension means 36 can be conceived as being divided into portions 37, 38, 39. The portions 37, 38 are suspended substantially freely from the elevator car 5 or from the counterweight 6. The mass of the compensating tension means 36 in the portion 37 generates a force $F_1$, which can also be described as a compensating tension means weight $F_1$ of the compensating tension means 36 and the portion 37. Accordingly, the mass of the compensating tension means 36 and the portion 38 generates a force $F_2$ which can also be described as a compensating tension means weight $F_2$ of the compensating tension means in the portion 38.

The design of the compensating device 34 is such that the sum of the supporting means weight $F_A$ and of the compensating tension means weight $F_1$ is at least approximately equal to the sum of the supporting means weight $F_G$ and the compensating tension means weight $F_2$. This equation is independent of the momentary position of the elevator car 5 and of the counterweight 6. This means that this equation applies at all times when the elevator car 5 covers the path of travel 18 upwardly or the path of travel 19 downwardly. If, for example, the elevator car 5 travels downwardly along the path of travel 19, the compensating tension means weight $F_1$ then reduces to the same extent to which the supporting means weight $F_A$ increases, whereas the compensating tension means weight $F_2$ increases to the same extent to which the supporting means weight $F_G$ decreases. The portion 37 of the compensating tension means 36 becomes shorter here, whereas the portion 38 of the compensating tension means 36 becomes longer.

The compensating device 34 comprises the deflecting device 35, which has a compensating tension means loop 40. The portion 39 of the compensating tension means 36 is disposed in the compensating tension means loop 40. Here, this is understood to mean that the compensating tension means 36 during operation also runs through the compensating tension means loop 40, wherein the conceived division into the portions 37 to 39 is possible. The compensating tension means loop 40 is arranged such that the mass of the compensating tension means 36 disposed in the compensating tension means loop 40, that is to say the mass of the portion 39 of the compensating tension means 36, contributes neither to the force $F_1$ nor to the force $F_2$. Here, the compensating tension means loop 40 is also provided such that direction-dependent forces, in particular friction forces, such as rolling friction forces, are avoided to the greatest possible extent. The influence of the guidance of the compensating tension means 36 by the compensating tension means loop 40 on the forces $F_1$, $F_2$ is thus kept as low as possible.

In order to form the compensating tension means loop 40, stationary deflecting rollers 41, 42 and displaceable deflecting rollers 43, 44 are used in this exemplary embodiment. The stationary deflecting rollers 41, 42 are arranged here in a stationary roller assembly 45, and the displaceable deflecting rollers 43, 44 are arranged in a displaceable roller assembly 49. The displaceable roller assembly 49 is displaceable by means of a displacement device 46. In this exemplary embodiment the displacement device 46 is used to raise and lower the displaceable roller assembly 49 in a vertical displacement direction 48. For lowering, the displaceable roller assembly 49 is provided with a sufficiently high inherent weight. It is thus sufficient that the displacement device 46 is embodied as a lifting gear with a transmission element 47 that is resistant only to tensile loading. For example, the transmission element 47 can be embodied here as a rope of a wire rope hoist. The displacement device could also comprise transmission elements resistant to tensile and compressive loading, for example threaded rods. The displacement device 46 could thus limit the freedom of movement of the displaceable roller assembly 49 both in the displacement direction 48 and against the displacement direction. The displaceable roller assembly 49 can be displaceable along a guide or also without guidance.

By means of the displacement device 46, the displaceable deflecting rollers 43, 44 used to form the compensating tension means loop 40 can be displaced jointly by displacement of the displaceable roller assembly 49. The displacement device 46 can be formed here in particular as an electric lifting gear or as a lifting gear operated by hand.

The displacement device 46 can also operate synchronously to a raising of the drive platform 16, such that the displacement of the displaceable deflecting rollers 43, 44 is synchronous to the raising 23 of the drive platform 16 during a lifting operation.

The compensating device 34 can thus be adapted to the lifting height 15 of the elevator system 1 increased by the lifting operation, before and/or during and/or after the lifting operation, in which the drive platform 16 is raised. This is achieved by changing the compensating tension means loop 40 along which the compensating tension means 36 is guided. Here, the distance between the two roller assemblies 45, 49 is reduced before and/or during the lifting operation, such that an amount of compensating tension means 36 necessary to perform the lifting operation is released from the compensating tension means loop 40. In this exemplary embodiment a first fastening point 50 of the compensating tension means 36 is connected by means of a fixing device 50.1 to the elevator car 5. The second fastening point 51 of the compensating tension means 36 is connected by means of a fixing device 51.1 to the counterweight 6. With this arrangement the portions 37, 38 of the compensating tension means 36 during the course of a lifting operation are extended by the same total length as that by which the supporting means portions 29, 30 are extended on the whole. At any operating height of the elevator system, the balance between the weight forces of the elevator-car-side and counterweight-side supporting means and compensating tension means acting on the friction hoist is thus retained.

In this exemplary embodiment the compensating tension means 36 is guided downwardly from the elevator car 5 to the deflecting device 35, which corresponds initially to the portion 37 of the compensating tension means 36. The compensating tension means 36 is then guided via the deflecting roller 57 of the deflecting device 35 and the stationary deflecting roller 41 of the compensating tension means loop 40. From the stationary deflecting roller 41, the compensating tension means 36 is then guided upwardly again, around the displaceable deflecting rollers 43, 44 of the compensating tension means loop 40, and then downwardly again to the stationary deflecting roller 42, which forms a second stationary deflecting roller of the compensating tension means loop 40. The length of the compensating tension means 36 between the stationary deflecting roller 41 and the stationary deflecting roller 42 corresponds on the whole approximately to the portion 39. From the stationary deflecting roller 42, the compensating tension means 36 is then guided upwardly via the deflecting roller 58 of the deflecting device 35 to the counterweight 6, which corresponds to the portion 38. The compensating tension means 36 is thus guided in a manner running from the elevator car 5, via the compensating tension means loop 40, to the counterweight 6. The portion 39 of the compensating tension means 36 thus forms substantially the amount, stored in the compensating tension means loop 40, of the compensating tension means guided from the bottom side of the elevator car 5 via the deflection device 35 to the bottom side of the counterweight.

The compensating tension means 36 is thus guided via at least one stationary deflecting roller 41, 42 used to form the compensating tension means loop 40 and at least one displaceable deflecting roller 43, 44 used to form the compensating tension means loop 40, wherein the at least one displaceable deflecting roller 43, 44 is displaced relative to the at least one stationary deflecting roller 41, 42, in order to change the compensating tension means loop 40 and therefore the amount or length of the compensating tension means stored in the compensating tension means loop. Here, two displaceable deflecting rollers 43, 44 used to form the compensating tension means loop 40 are displaced in this exemplary embodiment by means of the displacement device 46 in order to change the compensating tension means loop 40 or in order to release an amount of the compensating tension means 36 necessary for carrying out the lifting operation. In a modified embodiment, a different number of displaceable deflecting rollers 43, 44 can also be provided. A different number of stationary deflecting rollers 41, 42 can be provided accordingly.

With the shown guidance of the compensating tension means 36, the compensating tension means loop 40 is arranged in the elevator shaft 2, in which the elevator car 5 of the elevator system 1 is located. The compensating tension means loop 40 is thus located in the elevator shaft 2 associated with the elevator system 1.

Following the last lifting operation, in which the drive platform 16 is raised into its end position and the usable lifting height 15 is thus equal to the end height 15, a partial conversion of the elevator system 1 can be performed. Here, in particular the elements 41 to 49 used to form the compensating tension means loop 40 can be removed. In particular, the stationary deflecting rollers 41, 42, the displaceable roller assembly 49 comprising the displaceable deflecting rollers 43, 44, the displacement device 46 and the transmission element 47 resistant in this exemplary embodiment to tensile loading can be removed. Here, the stationary deflecting rollers 41, 42 can be disassembled or also can continue to be used in an altered arrangement accordingly in order to guide the compensating tension means 36. At least some of the elements 41 to 49 can thus be used again. The guidance of the compensating tension means 36 can be hereby simplified, such that few deflection points around which the compensating tension means is guided are provided thereafter. Due to the conversion of the compensating device 34 of the elevator system 1 performed after the last lifting operation, a compensating device 34 without compensating tension means loop 40 is thus produced.

FIG. 2 shows schematically an elevator system 1 in accordance with a further embodiment of the invention. Here, a situation in which the elevator car 5 is disposed higher up in the elevator shaft 2 compared to FIG. 1, whereas the counterweight 6 is disposed lower down in the elevator shaft 2 is shown. The counterweight-side supporting-means portion 30 of the supporting means 7 is thus now longer than the elevator-car-side supporting-means portion 29. Accordingly, the counterweight-side supporting-means weight $F_G$ is greater than the elevator-car-side supporting-means weight $F_A$.

The compensating device 34 is arranged in this exemplary embodiment partially outside the elevator shaft 2. Here, part 55 of the compensating device 34 is disposed in the elevator shaft 2, whereas the compensating tension means loop 40 is disposed outside the elevator shaft 2. The space in which the compensating tension means loop 40 is disposed in this exemplary embodiment is in this exemplary embodiment a further elevator shaft 54, which preferably is not yet being used for an elevator system. For example, when constructing the building, an arrangement of a number of elevator systems comprising the elevator system 1 may be planned. During the construction phase of the building, only the elevator system 1 for example can be formed as an elevator system 1 that grows along with the increasing building height. Further elevator systems, one of which is constructed in the further elevator shaft 54, are constructed only once the building is finished. The further elevator shaft 54 can then be used advantageously to receive the compensating tension means loop 40. This has the advantage that the spatial requirement of the compensating tension means loop 40 in the elevator shaft 2 of the elevator system 1 does not have to be taken into consideration. Furthermore, this can also simplify the installation of the displacement device 46, which for example is embodied as a lifting gear.

In this exemplary embodiment the stationary deflecting rollers 41, 42 of the compensating tension means loop 40 are arranged in the further elevator shaft 54 on the floor 10. Deflecting rollers 56, 57 are also arranged on the floor 10 of the elevator shaft 2. An aperture 75 in the shaft wall 8 of the elevator shaft 2 is left open between the stationary deflecting rollers 41, 42 and the deflecting rollers 56, 57. The compensating tension means loop 40 additionally comprises the displaceable deflecting roller 43. The displaceable deflecting roller 43 is displaceable jointly with the displaceable roller assembly 49 by the displacement device 46, wherein the displacement device in the present exemplary embodiment is embodied as a rope lifting gear.

The compensating tension means 36 is in this exemplary embodiment guided partially through the elevator shaft 2 which is associated with the elevator system 1 growing together with the increasing building height and partially through the further elevator shaft 54. Here, a first fastening point 58 of the compensating tension means 36 is fixed to the floor 10 of the elevator shaft 2 by means of a fixing device 58.1. Proceeding from its first fastening point 58, the compensating tension means 36 runs vertically upwardly through the elevator shaft 2 to the elevator car 5 and passes there around a deflecting roller 60 fastened to the elevator car 5. From the deflecting roller 60, the compensating tension means 36 runs vertically downwardly again and via the deflecting roller 56 to the stationary deflecting roller 41 of the stationary roller assembly 45 installed in the further elevator shaft 54. The compensating tension means 36 then runs vertically upwardly from the stationary deflecting roller 41 and around the displaceable deflecting roller 43 of the displaceable roller assembly 49. Compensating tension means 36 then extends vertically downwardly again to the stationary deflecting roller 42 of the stationary roller assembly 45 and then passes to the deflecting roller 57 on the floor 10 of the elevator shaft 2, which deflecting roller 57 deflects the compensating tension means 36 such that it runs vertically upwardly to a deflecting roller 61 installed on the counterweight 6. The compensating tension means 36 runs around this deflecting roller 61 and then extends downwards to its second fastening point 59, at which the compensating tension means 36 is fixed to the floor 10 by means of a fixing device 59.1.

With this arrangement of the compensating tension means 36, the portion 37 of the compensating tension means 36 effective on the elevator car side for compensating the supporting means weight comprises both the compensating tension means 36 between its first fasting point 58 and the deflecting roller 60 on the elevator car 5 and also the compensating tension means 36 between the deflecting roller 60 and the deflecting roller 56.

The compensating tension means weight $F_1$ loading the elevator car 5 is given in accordance with the mass of the compensating tension means 36 in the portion 37. Similarly, the portion 38 of the compensating tension means 36 effective on the counterweight side for compensating the supporting means weight comprises both the compensating tension means 36 between the deflecting roller 57 and the deflecting roller 61 on the counterweight and also the compensating tension means 36 between the deflecting roller 61 and the second fastening point 59 of the compensating tension means 36. Accordingly, in the case of the elevator system shown in FIG. 2, an adaptation of the compensating tension means 36 in respect of its mass per length unit is necessary. The compensating tension means 36 must in this case have a mass per length unit that is half that of the supporting means 7.

In this exemplary embodiment the compensating tension means 36 can thus be guided around a deflecting roller 60 connected to the elevator car 5. Furthermore, in this embodiment the compensating tension means 36 can be guided around a deflecting roller 61 connected to the counterweight 6.

As the drive platform 16 is raised in the direction marked by the arrow 23, wherein a necessary length of supporting means 7 is to be supplied from the supporting means reservoir 28 with said raising operation, the displaceable roller assembly 49 must be lowered with the displaceable deflecting roller 43 by means of the displacement device 46 in order to release the necessary amount or length of the compensating tension means 36 from the compensating tension means loop 40. However, the displaceable deflecting roller 43 does not necessarily have to be lowered synchronously with the raising of the drive platform, and instead it can be lowered before and/or during and/or after the raising of the drive platform 16. Furthermore, the compensating tension means 36 can also be tensioned by displacement of the displaceable deflecting roller 43 in the opposite direction, such that the distance between the displaceable deflecting roller 43 and the stationary deflecting rollers 41, 42 is increased. For example, prior to the lifting operation, the displaceable deflecting roller 43 can be lowered in the displacement direction 48 by a distance sufficient to release the amount of compensating tension means 36 necessary for the lifting operation, plus a certain reserve. The lifting operation of the drive platform 16 can then be carried out. After the lifting operation, the certain reserves can be compensated again by displacing the displaceable deflecting roller 43 in the opposite direction. The compensating tension means 36 is thus tensioned. An operation of this kind can also be performed in a corresponding manner in other embodiments or modified variants.

Figure 3:
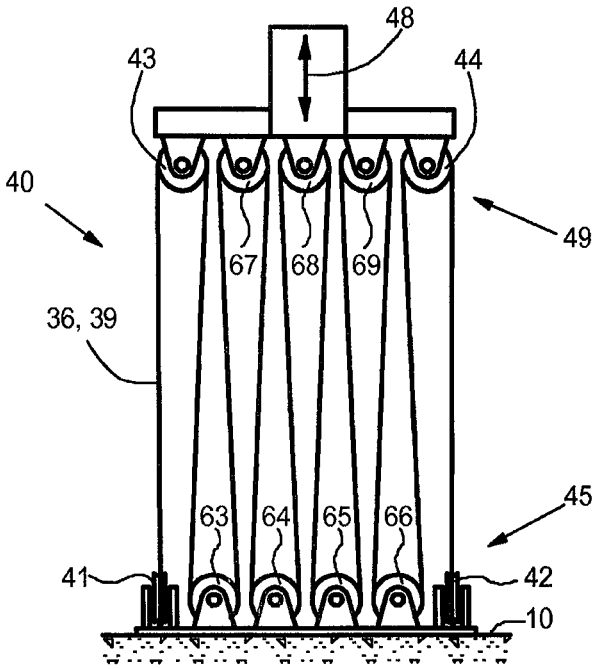
FIG. 3 shows a further embodiment of the deflecting device denoted by reference sign 35 in FIG. 1.

FIG. 3 shows a further embodiment of the deflecting device denoted by reference sign 35 in FIG. 1. In this embodiment a compensating tension means loop 40 with multiple reeving is provided. The multiple reeving in this case relates to the portion 39 of the compensating tension means 36 representing the stored amount of the compensating tension means 36. Besides the displaceable deflecting rollers 43, 44, further displaceable deflecting rollers 67 to 69 are arranged on the displaceable roller assembly 49. Furthermore, besides the stationary deflecting rollers 41, 42, further stationery deflecting rollers 63 to 66 of the stationary roller assembly 45 are arranged on the floor 10. In this way, the compensating tension means loop 40 can be used for example in the elevator system 1 described with reference to FIG. 1. With certain adaptations, a compensating tension means loop 40 with the multiple reeving shown in FIG. 3 can also be used in the elevator system 1 described with reference to FIG. 2.

In the embodiment described with reference to FIG. 3, the displacement of the displaceable deflecting rollers 43, 44, 67, 68, 69 belonging to the displaceable roller assembly 49 is performed jointly. However, modifications in which one or more of the deflecting rollers 43, 44, 67 to 69 of a multiple reeving are displaceable separately from one another are also conceivable.

Figure 4:
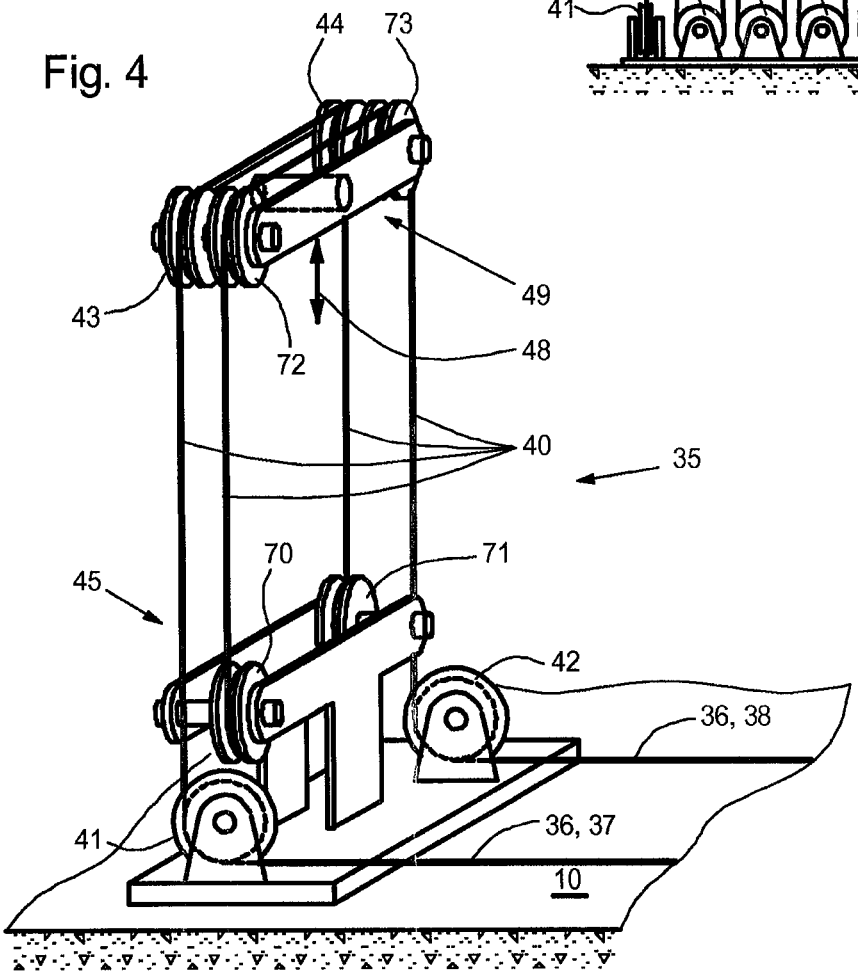
FIG. 4 shows a further embodiment of the deflecting device denoted by reference sign 35 in FIG. 1 in a schematic, three-dimensional depiction.

FIG. 4 shows a schematic three-dimensional illustration of a further embodiment of the deflecting device 35 with compensating tension means loop 40 which corresponds in terms of its effect to the deflecting device denoted by reference sign 35 in FIG. 1. In this embodiment stationary deflecting rollers 41, 42, 70, 71 are arranged in a stationary roller assembly 45 on the floor 10. Displaceable deflecting rollers 43, 44, 72, 73 are arranged in a schematically illustrated displaceable roller assembly 49. Both the stationary defecting rollers and the displaceable deflecting rollers are embodied as discs rotatable independently of one another having guide grooves for the compensating tension means 36. Coming from the stationary deflecting roller 41, the compensating tension means 36 runs firstly to the displaceable deflecting roller 43. From the displaceable deflecting roller 43, the compensating tension means 36 then runs further via the displaceable deflecting roller 44 and then downwardly to the stationary defecting roller 71 of the stationary roller assembly 45 on the floor 10. From the stationary deflecting roller 71, the compensating tension means 36 runs further to the stationary deflecting roller 70 and then upwardly to the displaceable deflecting roller 72. The compensating tension means 36 then runs via the displaceable deflecting roller 73 and downwardly again to the stationary deflecting roller 42 on the floor 10. The course of the compensating tension means 36 in the region of the compensating tension means loop 40 is thus described. With this rope guidance, there is an additional turn of the compensating tension means 36 along the compensating tension means loop 40. Accordingly, a number of additional turns—i.e. what is known as a multiple reeving—can also be provided. Additional turns enable the storage, with comparable dimensions, of a greater length of the compensating tension means 36, such that, in the event that the displaceable roller assembly 49 is lowered in the displacement direction 48 over a certain path, an amount of the compensating tension means 36 is released from the compensating tension means loop 40, with the length of said amount of the compensating tension means corresponding to a multiple of the aforesaid path.

The embodiment of the compensating tension means loop 40 described with reference to FIG. 4 can be used advantageously in the elevator system 1 described with reference to FIG. 1. In a corresponding modification, the compensating tension means loop 40 described with reference to FIG. 4 can also be used in the elevator system 1 described with reference to FIG. 2.

Possibilities in which a distance between the deflecting rollers of a compensating tension means loop 40 can be changed at least substantially in a vertical direction 48, as is described with reference to FIGS. 1 to 4, are thus described. However, it shall be understood that with a correspondingly modified embodiment a different orientation of the direction of this change and therefore a different orientation of the displacement direction 48 of the at least one displaceable deflecting roller in space is also possible. In particular, the displacement direction 48 can also be oriented at least substantially horizontally, as will be described hereinafter in an exemplary manner with reference to FIG. 5.

It has also been described that the compensating tension means loop 40 can be arranged in the elevator shaft 2 and/or another space, in particular a further elevator shaft 54. Especially with an arrangement in the elevator shaft 2 and/or a further elevator shaft 54, a displacement in a vertical displacement direction 48 is particularly advantageous, under consideration of the normal case of a vertically extending elevator shaft.

Figure 5:
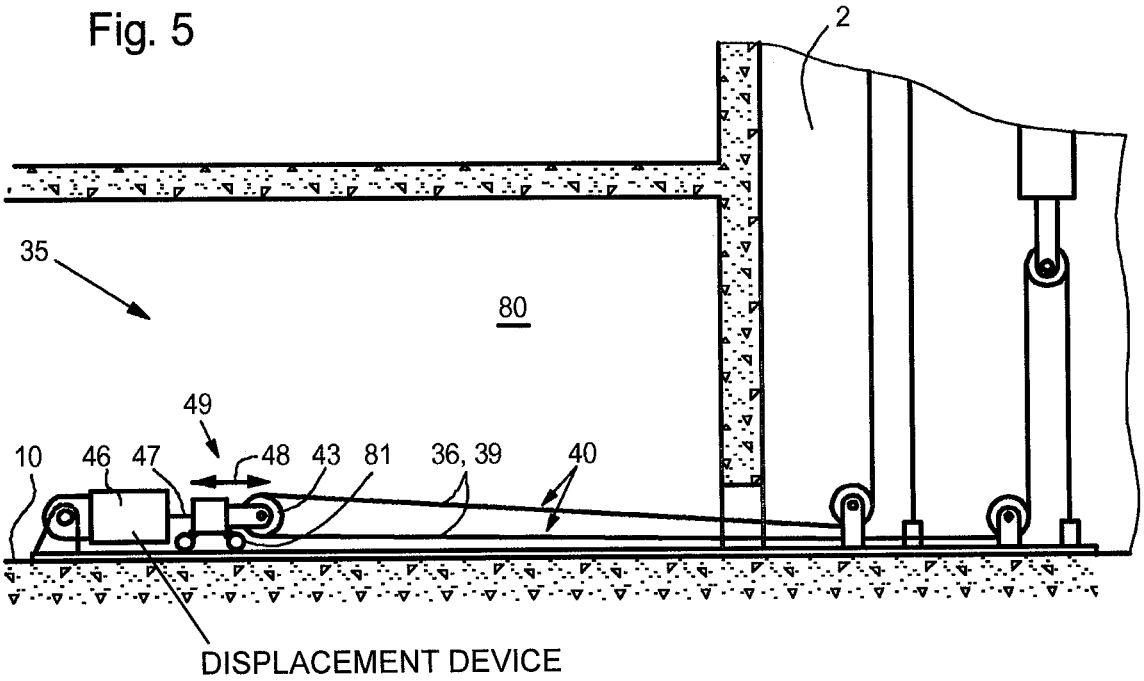
FIG. 5 shows a further embodiment of the deflecting device denoted by reference sign 35 in FIG. 2 with compensating tension means loop in a horizontal arrangement.

FIG. 5 shows a further embodiment of the deflection device 35 denoted by reference sign 35 in FIG. 2 with compensating tension means loop 40 in a horizontal arrangement. Here, the deflecting device 35 is preferably installed in a space 80 not associated with an elevator shaft 2 of the building. For example, the space 80 can be an underground car park hall which is used for the parking of motor vehicles. The deflecting rollers 56, 57 necessary in the embodiment according to FIG. 2 are spared when the arrangement shown in FIG. 5 is provided. The portion 39 of the compensating tension means 36—i.e. the compensating tension means loop 40—can extend here at least approximately horizontally through the space 80, wherein it is deflected at the displaceable deflecting roller 43. The displaceable at least one deflecting roller 43 mounted on the displaceable roller assembly 49 can be displaced by means of the displacement device 46 illustrated schematically. The displacement device 46 can be arranged here on the floor 10. The displacement device 46 enables a displacement of the displaceable roller assembly 49 in the displacement direction 48 by means of the transfer transmission element 47, which can be a rope resistant to tensile loading. A certain tensioning force in the compensating tension means 36 can also be brought about by means of the displacement device 46 and is maintained during operation. As the drive platform 16 is raised, this tensioning force can then be reduced accordingly. In a modified embodiment the displaceable deflecting roller 43, however, can also be released already before the lifting operation and displaced in the displacement direction 48. The displaceable deflecting roller 43 can be supported here suitably also relative to the floor 10, for example via a trolley 81.

The invention is not limited to the described embodiments and modifications.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for constructing an elevator system in a building, the elevator system including an elevator drive machine, an elevator car, a counterweight, and a flexible supporting means, the method including performing at least one lifting operation to adapt a usable lifting height of the elevator system to an increasing height of the building, the at least one lifting operation raising a drive platform that supports the elevator drive machine and, by the supporting means, supports the elevator car and the counterweight, and the method further including substantially compensating a difference between an elevator-car-side supporting-means weight and a counterweight-side supporting-means weight of the supporting means by a compensating tension means that is guided from a bottom side of the elevator car to a bottom side of the counterweight by a deflecting device, the method comprising the further steps of:

guiding the compensating means with the deflecting device, the deflecting device including two roller assemblies each having at least one deflecting roller, wherein the compensating tension means is guided by the at least one deflecting roller of each of the two roller assemblies to form a compensating tension means loop in which loop a defined amount of the compensating tension means is stored; and reducing a distance between the two roller assemblies at least one of before and during the at least one lifting operation such that an amount of the compensating tension means required for performance of the at least one lifting operation is released from the compensating tension means loop.

2. The method according to claim 1 wherein one of the roller assemblies is a stationary roller assembly having at least one stationary deflecting roller as the at least one deflecting roller and another of the roller assemblies is a displaceable roller assembly having at least one displaceable deflecting roller as the at least one deflecting roller.

3. The method according to claim 1 wherein the defined amount of the compensating tension means stored in the compensating tension means loop is formed by a portion of the compensating tension means guided from the bottom side of the elevator car via the deflecting device to the bottom side of the counterweight.

4. The method according to claim 1 including fixing at least indirectly a first fastening point of the compensating tension means to the elevator car and fixing at least indirectly a second fastening point of the compensating tension means to the counterweight, or guiding the compensating tension means around further deflecting rollers connected to the elevator car and to the counterweight.

5. The method according claim 1 including fixing the compensating tension means by fixing devices to the elevator car and to the counterweight or fixing the compensating tension means by stationary fixing devices to the elevator system, wherein the compensating tension means remains fixed by the fixing devices or the stationary fixing devices before, during and after the at least one lifting operation.

6. The method according to claim 1 including guiding the compensating tension means with a single turn along the compensating tension means loop.

7. The method according to claim 1 including guiding the compensating tension means with more than one turn along the compensating tension means loop, or guiding the compensating tension means with a multiple reeving along the compensating tension means loop.

8. The method according to claim 1 including displacing at least one of the roller assemblies that forms the compensating tension means loop with an electrically driven displacement device to reduce or increase the distance between the two roller assemblies.

9. The method according to claim 1 displacing the roller assemblies that form the compensating tension means loop in opposite directions with a displacement device.

10. The method according to claim 1 including displacing at least one of the roller assemblies that forms the compensating tension means loop with a displacement device approximately synchronously with the raising of the drive platform during the at least one lifting operation.

11. The method according to claim 1 including arranging the compensating tension means loop at least largely in an elevator shaft associated with the elevator system, wherein at least one of the roller assemblies of the deflecting device is displaceable substantially in a vertical displacement direction.

12. The method according to claim 1 wherein the elevator system is associated with an elevator shaft and including arranging the compensating tension means loop at least in part in a further elevator shaft.

13. The method according to claim 1 wherein the elevator system is associated with an elevator shaft and including arranging the compensating tension means loop at least in part in a space not associated with the elevator shaft.

14. The method according to claim 1 including displacing at least one of the roller assemblies of the deflecting device in a substantially horizontal displacement direction.

15. The method according to claim 1 including after a last lifting operation removing elements of the deflecting device used to form the compensating tension means loop and converting the deflecting device into a deflecting device without the compensating tension means loop.

* * * * *